US007837427B2

(12) United States Patent
Beckel et al.

(10) Patent No.: US 7,837,427 B2
(45) Date of Patent: Nov. 23, 2010

(54) METHOD OF TRANSPORTING AND STORING AN OILFIELD PROPPANT

(75) Inventors: Jeff Beckel, Parker, CO (US); Roger Keese, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 392 days.

(21) Appl. No.: 11/774,978

(22) Filed: Jul. 9, 2007

(65) Prior Publication Data

US 2008/0008562 A1 Jan. 10, 2008

Related U.S. Application Data

(60) Provisional application No. 60/819,332, filed on Jul. 7, 2006.

(51) Int. Cl.
*B65G 57/00* (2006.01)
*B65G 61/00* (2006.01)

(52) U.S. Cl. ..... 414/801; 414/133; 414/356; 414/384; 414/386; 404/108

(58) Field of Classification Search ..... 198/311; 414/133, 356, 373, 376, 384, 502, 528, 573–574
See application file for complete search history.

(56) References Cited

U.S. PATENT DOCUMENTS 1,331,883 A * 2/1920 Stuart ..... 414/133
1,573,664 A * 2/1926 Wetherill ..... 414/133
3,378,152 A * 4/1968 Warner ..... 414/574
3,601,244 A * 8/1971 Ort et al. ..... 198/510.1
4,063,656 A * 12/1977 Lambert ..... 414/384
4,350,241 A * 9/1982 Wenzel ..... 198/311
4,363,396 A * 12/1982 Wolf et al. ..... 198/508
4,402,392 A * 9/1983 Fabian et al. ..... 198/311
4,407,202 A * 10/1983 McCormick ..... 105/271
5,286,158 A * 2/1994 Zimmerman ..... 414/504
5,470,175 A * 11/1995 Jensen et al. ..... 404/72
6,508,615 B2 * 1/2003 Taylor ..... 414/133
6,835,041 B1 * 12/2004 Albert ..... 414/386
2005/0201851 A1 * 9/2005 Jonkka ..... 414/133
2006/0239806 A1 * 10/2006 Yelton ..... 414/502

* cited by examiner

*Primary Examiner*—Gregory W Adams
(74) *Attorney, Agent, or Firm*—Rodney Warfford; Michael Dae; David Cate

(57) ABSTRACT

A method of transporting and storing an oilfield proppant is provided that includes transporting the proppant to a storage facility by use of a dump truck; providing a load assembly at the storage facility which comprises a load hopper and a load conveyor; transferring the proppant from the dump truck to the load hopper; and operating the load conveyor to transport the proppant from the load hopper to a proppant storage area of the storage facility to form an accumulation of stored proppant therein.

20 Claims, 8 Drawing Sheets

METHOD OF TRANSPORTING AND STORING AN OILFIELD PROPPANT

CROSS-REFERENCE TO RELATED APPLICATION

This application claims priority under 35 U.S.C. §119(e) to U.S. Provisional Application Ser. No. 60/819,332 filed on Jul. 7, 2006, which is incorporated herein by reference.

FIELD OF THE INVENTION

The present invention relates generally to an oilfield proppant storage facility and/or to a method of transporting and storing such a proppant by use of the proppant storage facility.

BACKGROUND

Hydraulic fracturing is a stimulation treatment routinely performed on oil and gas wells in low-permeability reservoirs. In such treatments, specially engineered treatment fluids are pumped at high pressure and rate into the well to create fractures extending perpendicularly from the wellbore in opposing directions according to the natural stresses within the well formation. Typically, a proppant, such as grains of sand of a particular size, are mixed with the treatment fluid to create a plane of high-permeability material through which production fluids can flow. The proppant remains in place once the hydraulic pressure is removed and therefore props open the fracture to enhance flow in the wellbore.

Such fracturing operations are very common and require large amounts of proppant. Accordingly, a need exists for efficient storage and transportation of fracturing proppants.

SUMMARY

In one embodiment, the present invention is a method of transporting and storing an oilfield proppant that includes transporting the proppant to a storage facility by use of a side dump truck. The side dump truck may include a trailer; a hopper mounted on the trailer for containing the proppant; and a side dumping mechanism for tilting the side dump truck hopper about a longitudinal axis of the trailer. The method also includes providing a linearly movable load assembly at the storage facility which comprises a load hopper and a load conveyor; operating the side dumping mechanism to transfer the proppant from the side dump truck hopper to the load hopper; and operating the load conveyor to transport the proppant from the load hopper to a proppant storage area of the storage facility to form an accumulation of stored proppant therein. The method may further include providing an unload assembly at the storage facility which comprises an unload hopper and an unload conveyor; transferring proppant from the accumulation of stored proppant to the unload assembly; and operating the unload conveyor to transport the proppant from the unload hopper to a removal truck for transporting the proppant away from the storage facility.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF EMBODIMENTS OF THE INVENTION

Figure 1:
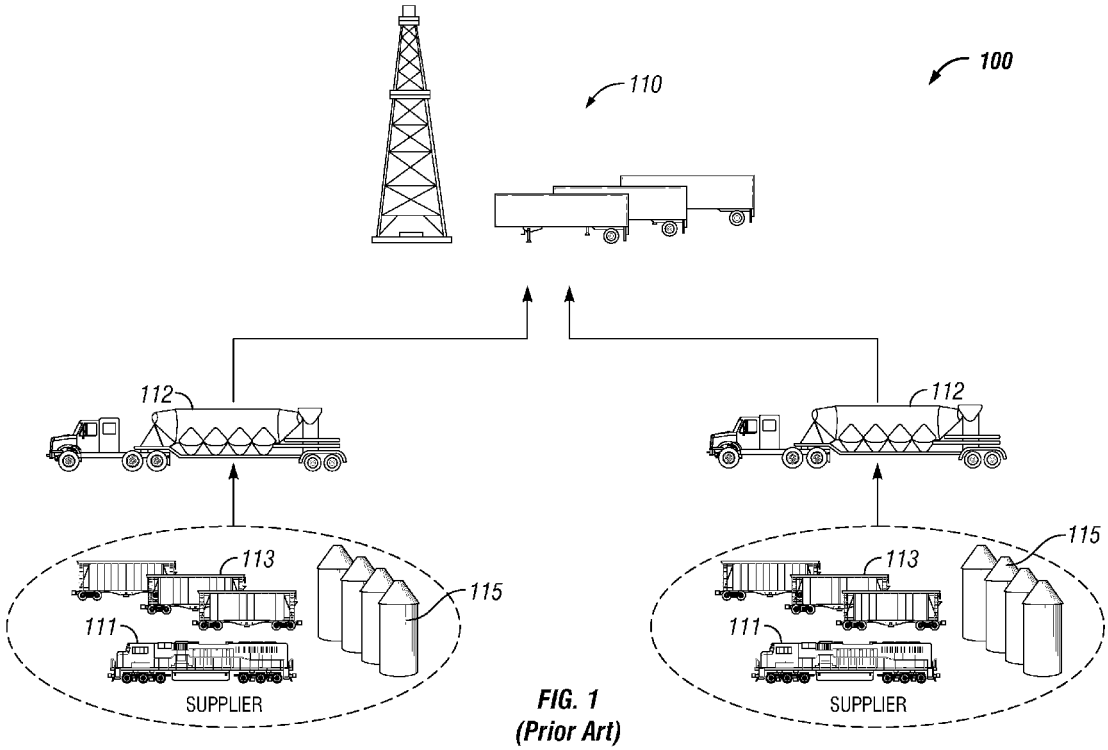
FIG. 1 (Prior Art)
FIG. 1 is a schematic representation of a proppant storage and transportation process according to the prior art.

FIG. 1 shows a proppant storage and transportation process 100 according to the prior art. In such a process 100, a proppant purchaser typically receives proppant from a proppant supplier directly by rail 111 or from temporary storage locations in rail cars 113 or silos 115. The purchaser then typically loads the proppant into an air slide 112 and transports the proppant either directly to a well site 110 or temporally stores the proppant in its own rail cars 113 or silos 115.

Such a process 100 involves several disadvantages and inefficiencies. For example, an air slide 112 takes a considerable amount of time to load/unload proppant from its pressurized tank. This loading/unloading is typically performed by adding/removing proppant from the pressurized tank of the air slide 112 by use of a pneumatic hose. However, both the loading and the unloading of proppant with respect to the pressurized tank takes approximately one hour of time. In addition, since the proppant will either be transported directly to a well site 110 or placed in a limited capacity storage unit (e.g., a rail car 113 or a silo 115) by use of such a process 100, timing in the ordering of the proppant by the purchaser must by done very precisely. For example, if proppant orders are delayed or miscalculated, or if the limited capacity storage units are low or empty, well site services such as fracturing operations are consequently delayed.

Figure 2:
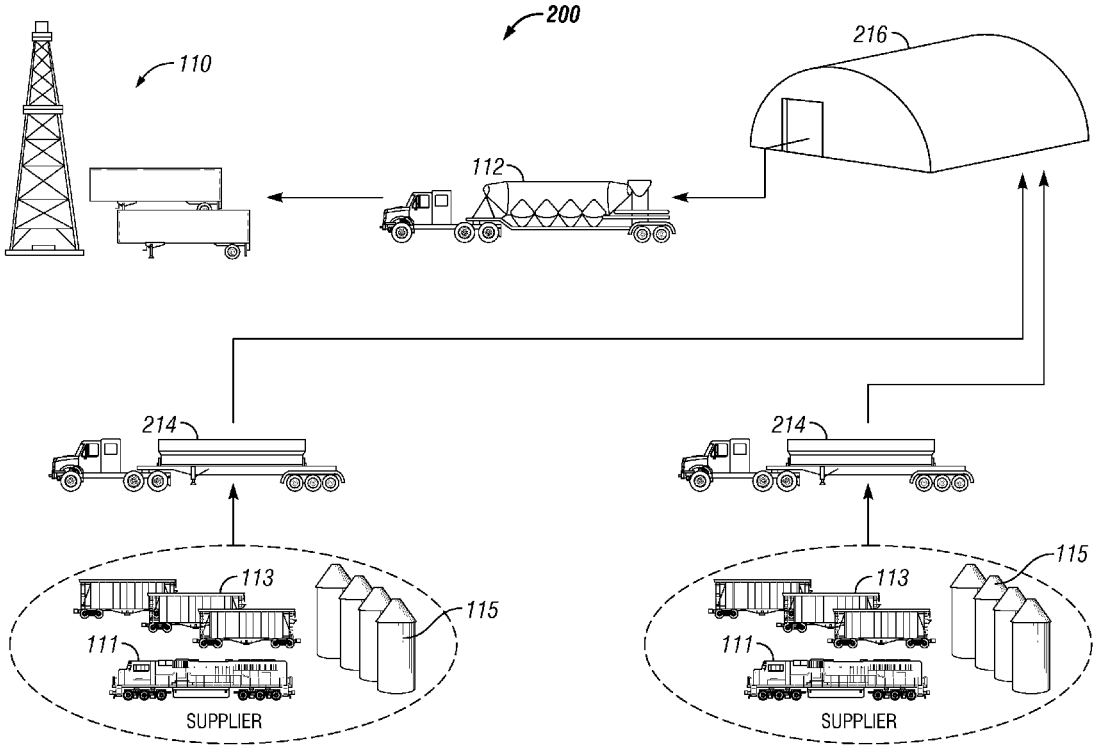
FIG. 2 is a schematic representation of a proppant storage and transportation process according to the one embodiment of the present invention.

FIG. 2 shows a proppant storage and transportation process 200 according to one embodiment of the present invention. In such a process 200, a purchaser receives proppant from a supplier directly by rail 111 or from temporary storage locations in rail cars 113 or silos 115. The purchaser loads the proppant into a dump truck, such as a side dump truck 214 (see also FIGS. 4A-4B), and transports the proppant to a proppant storage facility 216 (see also FIG. 3). The side dump truck 214 may be loaded and unloaded much faster than the loading and unloading of the air slides 112 in the above described process 100. For example, it is typical for side dump trucks 214 to be loaded or unloaded in approximately 5-10 minutes, as opposed to the approximately 60 minutes that it takes to load or unload an air slide 112.

In addition, the proppant storage facility 216 of the present invention can store much more proppant than previous storage facilities. For example, in one embodiment the proppant storage facility 216 can store approximately 25 million pounds of proppant, whereas a typical bank of several silos 115 can only store approximately 4-6 million pounds of proppant. From the proppant storage facility 216, proppant may be transported to a well site 110 by an air slide 112 as described in further detail below. Note that for the purpose of this disclosure, proppant includes naturally occurring sand grains, and man-made or specially engineered proppants, such as resin-coated sand or high-strength ceramic materials like sintered bauxite, among other appropriate oilfield proppants.

Figure 3:
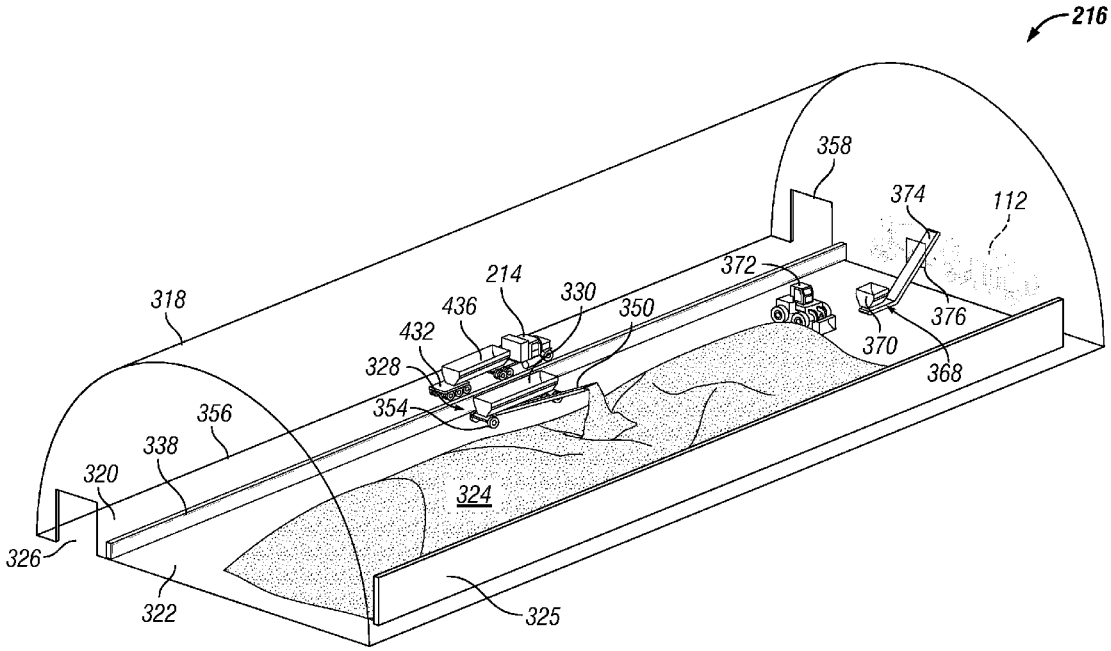
FIG. 3 is a proppant storage facility according to one embodiment of the present invention.

FIG. 3 shows a proppant storage facility 216 according to one embodiment of the present invention. In the depicted embodiment, the storage facility 216 is substantially semi-cylindrically shaped or otherwise includes a curve shaped roof 318 overhanging a ground area that is separated into a drive through area 320 and a proppant storage area 322. As shown, the drive through area 320 is in the form of a lane, which in one embodiment is sized appropriately for accommodating the width of a side dump truck 214 (as such, the drive through area 320 may also be referred to as a truck lane). The proppant storage area 322 is sized, in one embodiment, to store approximately 25 million pounds of proppant 324.

In one embodiment, the proppant storage and transportation process 200 includes transferring proppant from a side dump truck 214 to the storage facility 216 by transporting the side dump truck 214 into an entrance 326 of the storage facility 216 and along the truck lane 320 until the side dump truck 214 is adjacent to a load hopper and conveyor assembly 328. Once so positioned, proppant stored in a hopper portion 436 of the side dump truck 214 may be dumped directly into a hopper portion 330 of the load hopper and conveyor assembly 328.

Figure 4A:
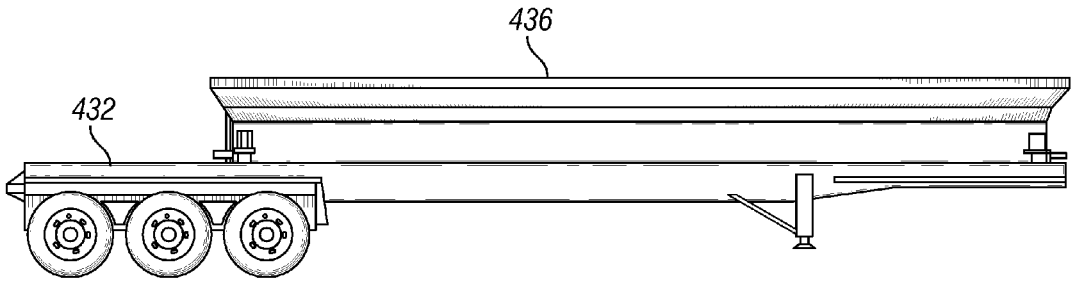
FIGS. 4A and 4B are side and back views, respectively, of a side dump truck for use with the proppant storage and transportation process of the present invention.
Figure 4B:
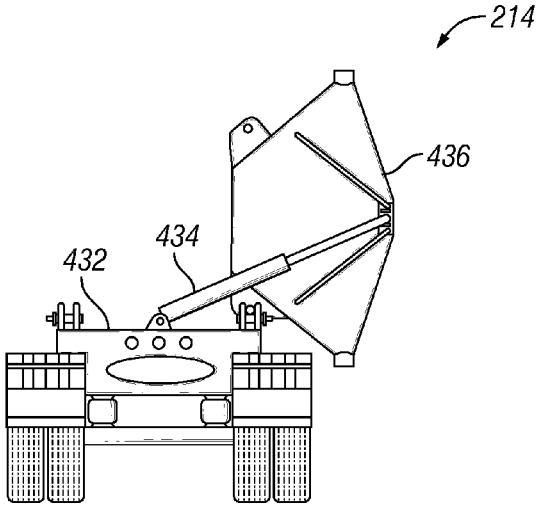

FIGS. 4A and 4B show a side dump truck trailer 432, upon which a hopper portion 436 of the side dump truck 214 is mounted. Connected to both the truck hopper 436 and the truck trailer 432 is a mechanism 434 (as shown in FIG. 4B) for accomplishing a "side dumping" of proppant from the truck hopper 436 to the hopper 330 of the load hopper and conveyor assembly 328 (i.e. the side dumping mechanism 434 is operable to tilt the truck hopper 436 about a longitudinal axis of the trailer 432).

Although the side dumping mechanism 434 in the depicted embodiment is a hydraulic cylinder, any appropriate dumping mechanism 434 may be used. Note that although it is not necessary for the dump truck 214 to be a side dumping truck, in embodiments where the dump truck 214 is a side dumping truck, the truck lane 320 of the storage facility 216 may be minimized, thus maximizing the space 322 in the storage facility 216 that can be used for the storage of proppant 324.

Preferably, the load hopper 330 is sized substantially the same as or slightly larger than the hopper 436 on the side dump truck trailer 432 at least in the length dimension. Such a sizing of the hoppers 300, 436 facilitates the transfer or "dumping" of proppant from the side dump truck 214 to the load hopper 330.

In one embodiment, a barrier wall 338 may be placed between the truck lane 320 and the proppant storage area 322 of the storage facility 216. This wall 338 ensures that overspill during the dumping of proppant from the side dump truck 214 to the load hopper 330 is retained in the proppant storage area 322 side of the storage facility 216. In addition, the wall 338 ensures that dirt, mud and/or other debris from the tires or body of the side dump truck 214 are not transferred into the proppant storage area 322 side of the storage facility 216. Similarly, a second barrier wall 325 may be positioned in the proppant storage area 322 side of the storage facility 216 at a position near the side walls of the storage facility 216.

Note that as soon as the proppant from the side dump truck 214 has been emptied into the load hopper and conveyor assembly 328 (a process which should take approximately 5-10 minutes). The side dump truck 214 may be immediately removed from the storage facility 216 (thus minimizing driver wait time) by driving the side dump truck 12 through the truck lane 320 and out an exit 358 of the storage facility 216. Preferably, the truck lane 320 and the corresponding entrance 326 and exit 358 thereto are each slightly larger than a safe width for transporting the side dump truck 214. Such a configuration allows the proppant storage area 322 of the storage facility 216 to be maximized. Note that the storage facility 216 may include doors at the entrance 326 and exit 358 thereof, however, these doors have been omitted from FIG. 3 for clarity purposes.

Figure 5A:
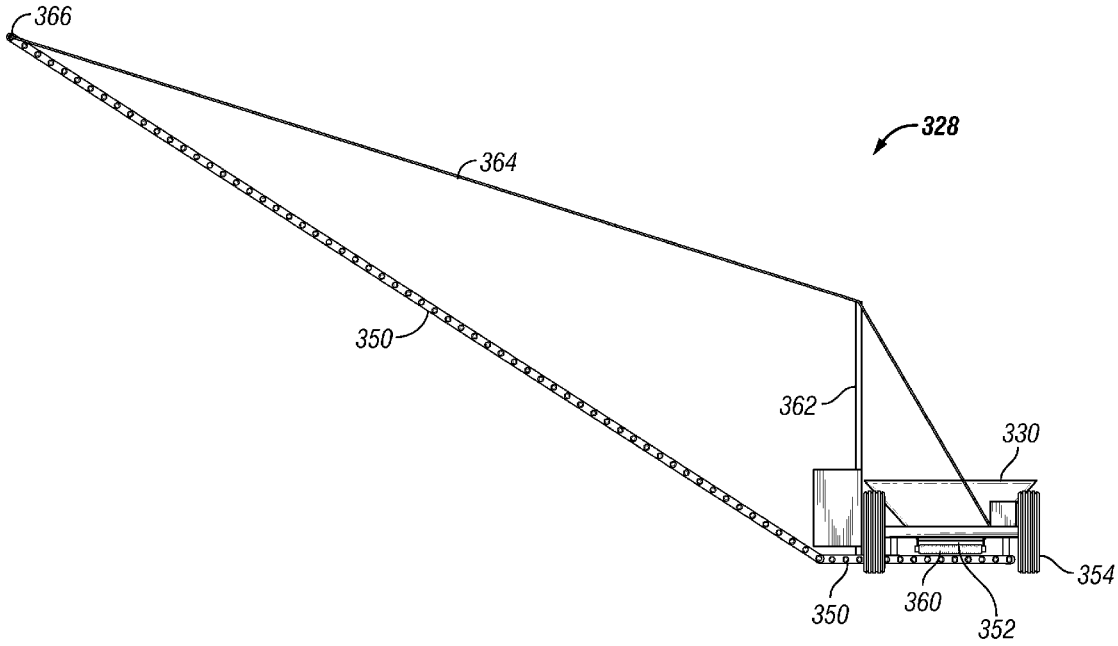
FIGS. 5A-5C are end, side and top views, respectively, of a conveyor and hopper device for use with the proppant storage and transportation process of the present invention.
Figure 5B:
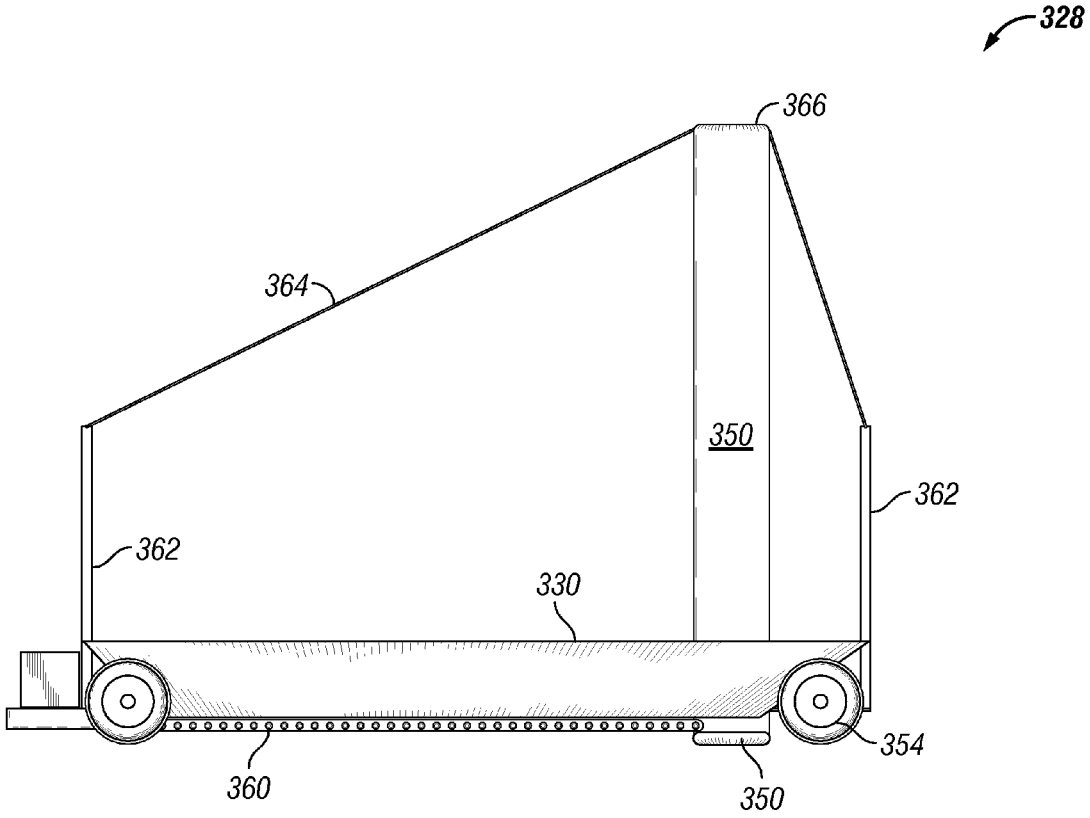
Figure 5C:
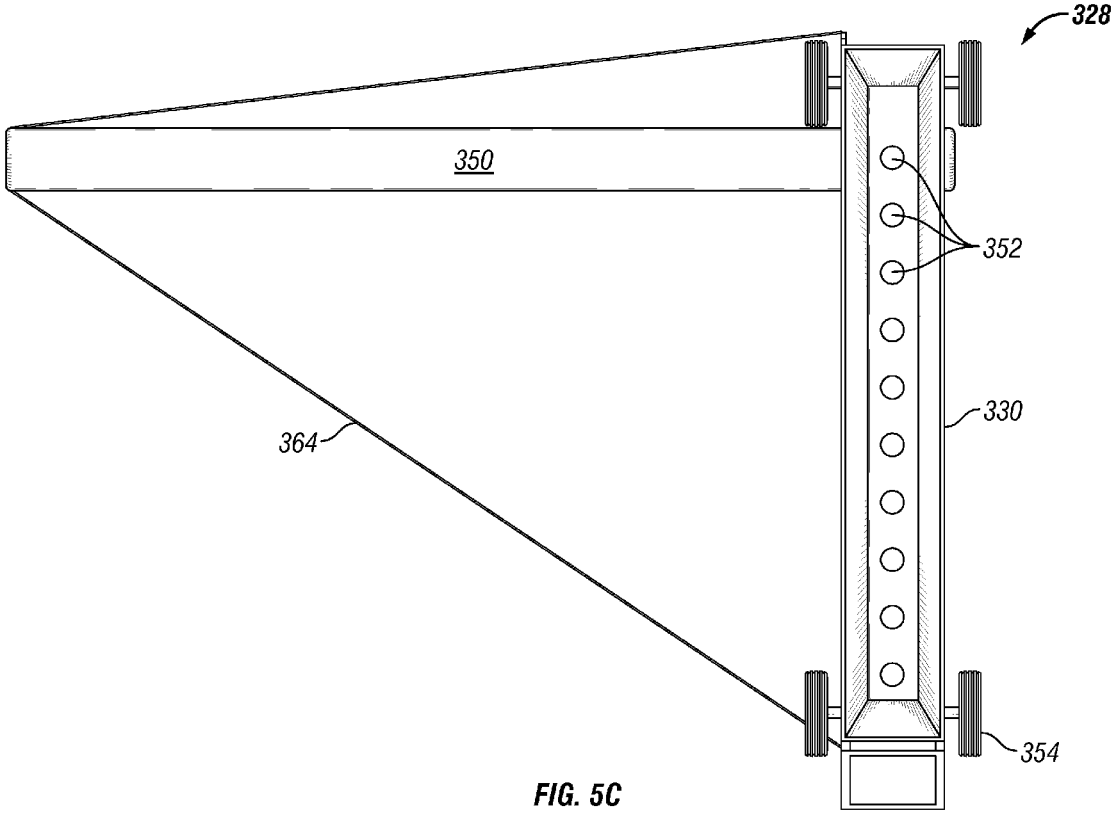

As shown in FIGS. 5A-5C, in one embodiment the load hopper and conveyor assembly 328 includes, as its name implies, the load hopper 330 and a load conveyor 350. In one embodiment, the load conveyor 350 is mounted to the load hopper 330 and extends cantileverly therefrom. Underneath the load hopper 330 is a horizontal conveyor 360 that receives proppant which is discharged from exit ports 352 (as shown in FIG. 5C) in the load hopper 330 and transports the discharged proppant to the load conveyor 350. As such, an end of the horizontal conveyor 360 which is adjacent to the load conveyor 350 is preferably at the level of or higher than its adjacent portion of the load conveyor 350 (see for example, FIG. 5A).

The cantilever hanging of the load conveyor 350 from the load hopper 330 allows the load conveyor 350 to drop proppant into an accumulating pile of stored proppant 324 that grows in the space beneath the load conveyor 350. Such a configuration maximizes an amount of stored proppant 324 that can be stored in the space beneath the load conveyor 350. That is, if the load conveyor 350 were to include under supports, such supports would prevent the pile of stored proppant 324 from growing in the area of such under supports.

In one embodiment, the load hopper and conveyor assembly 328 includes a support structure 362, such as one or more pipes of steel tubing, attached to the load hopper 330, and a wire 364 connecting the support structure 362 to the load conveyor 350, preferably at or near an outer end 366 thereof to form an upper support for the load conveyor 350. Such an upper support provides structural support to the load conveyor 350, without disrupting the flow of proppant from the load conveyor 350 as would occur if under supports were attached to the load conveyor 350 as explained above.

In one embodiment, the load hopper and conveyor assembly 328 includes a transportation mechanism 354, such as wheels or a track, or another appropriate mechanism for moving the load hopper 330 along the length 356 of the storage facility 216, or in some other direction within the storage facility 216. The transportation mechanism 354 allows the load hopper and conveyor assembly 328 to be moved along the length 356 of the storage facility 216 when the pile of stored proppant 324 beneath the load conveyor 350 begins to reach the height of the outer end 366 of the load conveyor 350, or when it is otherwise desired to redirect the exiting point of the proppant from the load conveyor 350. Preferably, the transportation mechanism 354 is powered.

Note that the pile of stored proppant 324 naturally takes on a curved shape. To match this curved shape of the stored proppant 324, the roof 318 of the storage facility may be curved. However, the roof may have other shapes as well.

When it is desired to transfer proppant from the storage facility 216 to the well site 110, an unload hopper and conveyor assembly 368 may be used to transfer proppant from the pile of stored proppant 324 in the proppant storage area 322 of the storage facility 216 to a transport vehicle, such as an air slide 112. This may be accomplished by loading stored proppant 324 from the proppant storage area 322 into a hopper 370 of the unload hopper and conveyor assembly 368, by use of a wheel loader 372, such as a Cat 928G Loader.

As shown, the unload hopper and conveyor assembly 368 includes the unload hopper 370 for receiving and storing proppant and an unload conveyor 374 for transporting proppant from the unload hopper 370 to the air slide 112. As such, similar to the load hopper 330, the unload hopper 370 may include one or more ports for discharging proppant from the unload hopper 370 to the unload conveyor 374, which then transports the discharged proppant to the air slide 112.

As shown, the storage facility 216 may include a side window 376 for allowing the unload conveyor 374 to extend externally from the storage facility 216 and into the air slide 112. As with the above described unloading of the side dump truck 214, this loading of the air slide 112 by use of the unload hopper and conveyor assembly 368 may be accomplished in approximately 5-10 minutes, rather than the approximately 60 minutes that it takes to load an air slide 112 by a conventional pneumatic hose. Once filled with a desired amount of proppant, the air slide 112 may be transported from the storage facility 216 to the well site 110.

Figure 6:
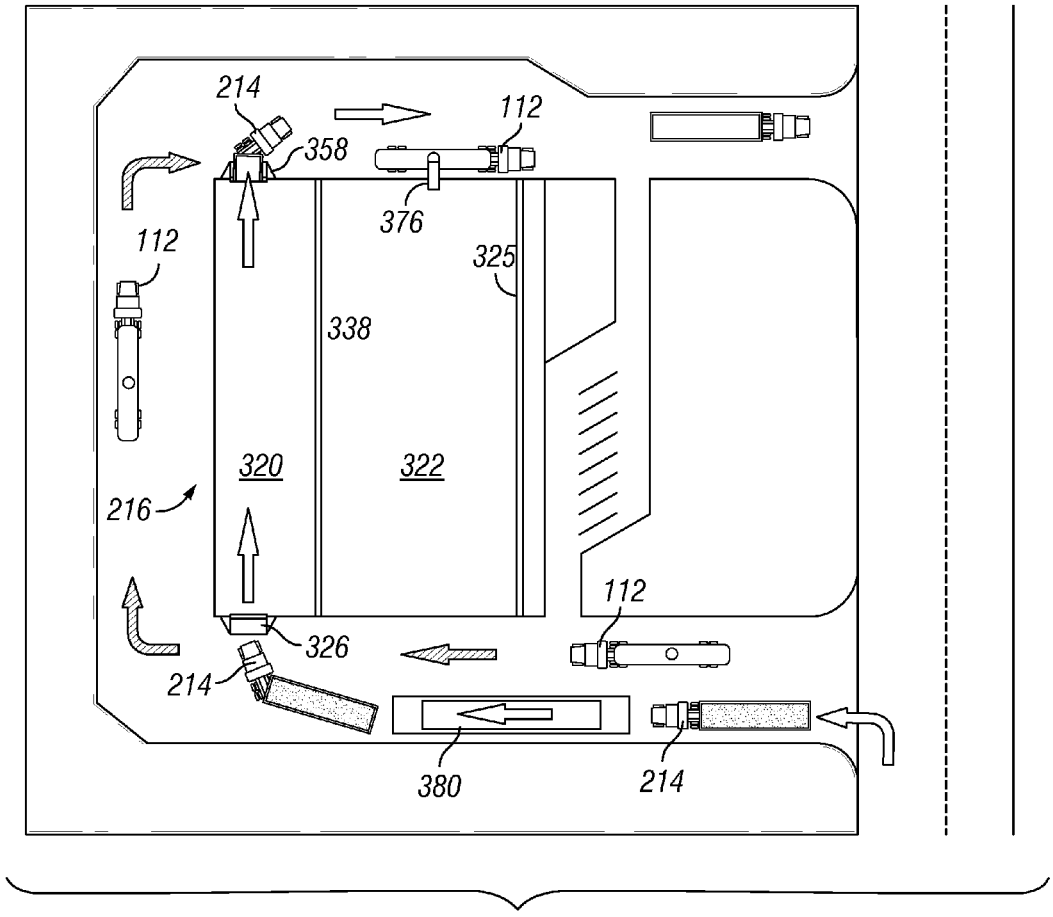
FIG. 6 shows an example of traffic flow about the proppant storage facility of FIG. 3.

FIG. 6 shows an example of traffic flow about the storage facility 216, with cross-hatched arrows showing preferred routes for loading trucks 112 and solid arrows showing preferred routes for unloading trucks 214. As shown, a weigh station 380 may also be positioned near the entrance 326 of the storage facility 216 in order to determine the weight of proppant being carried by the unloading trucks 214.

Note that by use of the above described proppant storage facility 216, proppant may be stored and transported much more efficiently and timely than previously available methods. In addition, precise timing previously requiring in the ordering of proppant is lessened by the large storing capacity of the storage facility 216 of the present invention.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. For example, although the above description focuses on the transportation and storage of proppants, the above described process may be used to store and transport any appropriate product, including other types of oil and gas well additives, stimulants, and/or chemicals, as well as products unrelated to the oil field, such as food products.

Accordingly, the foregoing description should not be read as pertaining only to the precise structures described and shown in the accompanying drawings, but rather should be read as consistent with and as support for the following claims, which are to have their fullest and fairest scope.

The invention claimed is:

1. A method of transporting and storing an oilfield proppant comprising:

receiving the proppant from a rail car or a silo;

loading the proppant into a dump truck;

transporting the proppant to a storage facility by use of the dump truck;

providing a load assembly at the storage facility which comprises a load hopper and a load conveyor;

unloading the dump truck into the load hopper in less than approximately 10 minutes; and operating the load conveyor to transport proppant from the load hopper to a proppant storage area of the storage facility to form an accumulation of stored proppant therein.

2. The method of claim 1, wherein the storage facility is of a size sufficient for storing approximately 25 million pounds of the accumulation of stored proppant.

3. The method claim 1, wherein the load conveyor is cantileverly supported by the load hopper.

4. The method claim 1, wherein the load conveyor is connected to the load hopper by one or more upper supports.

5. The method of claim 1, wherein the load assembly is linearly movable by a powered transportation mechanism.

6. The method of claim 1, wherein the dump truck comprises a hopper in which the proppant is transported, and wherein the load hopper is at least as long in length as the length of the dump truck hopper.

7. The method of claim 1, further comprising:

providing an unload assembly at the storage facility which comprises an unload hopper and an unload conveyor; and transferring proppant from the accumulation of stored proppant to the unload assembly.

8. The method claim 7, wherein said transferring of proppant from the accumulation of stored proppant to the unload assembly is preformed by operation of a wheel loader.

9. The method claim 7, further comprising operating the unload conveyor to transport the proppant from the unload hopper to a removal truck for transporting the proppant away from the storage facility.

10. The method of claim 9, wherein said transporting of the proppant from the unload hopper to said removal truck is accomplished in less than approximately 10 minutes.

11. The method of claim 1, wherein said storage facility comprises a roof overhanging a ground area that is separated into a drive through area and a proppant storage area.

12. A method of transporting and storing an oilfield proppant comprising:

receiving the proppant from a rail car or a silo;

loading the proppant into a side-dump truck;

transporting the proppant to a storage facility by use of the side-dump truck, wherein the side-dump truck comprises:

a trailer, a hopper mounted on the trailer for containing the proppant, and a dumping mechanism for tilting the side-dump truck hopper relative to the trailer;

providing a load assembly at the storage facility which comprises a load hopper and a load conveyor;

operating the dumping mechanism to transfer the proppant from the dump truck hopper to the load hopper, whereby the side-dump truck hopper is unloaded in less than approximately 10 minutes; and operating the load conveyor to transport the proppant from the load hopper to a proppant storage area of the storage facility to form an accumulation of stored proppant therein.

13. The method claim 12, wherein operating the dumping mechanism to transfer the proppant from the dump truck hopper to the load hopper comprises tilting the dump truck hopper about a longitudinal axis of the trailer.

14. The method of claim 12, wherein the storage facility is of a size sufficient for storing approximately 25 million pounds of the accumulation of stored proppant.

15. The method claim 12, wherein the load conveyor is cantileverly supported by the load hopper.

16. The method claim 12, wherein the load conveyor is connected to the load hopper by one or more upper supports.

17. The method of claim 12, wherein the load assembly is linearly movable by a powered transportation mechanism.

18. The method of claim 12, further comprising:

providing an unload assembly at the storage facility which comprises an unload hopper and an unload conveyor;

transferring proppant from the accumulation of stored proppant to the unload assembly; and operating the unload conveyor to transport the proppant from the unload hopper to a removal truck for transporting the proppant away from the storage facility.

19. The method of claim 18, wherein said transporting of the proppant from the unload hopper to said removal truck is accomplished in less than approximately 10 minutes.

20. The method of claim 12, wherein said storage facility comprises a roof overhanging a ground area that is separated into a drive through area and a proppant storage area.

* * * * *